United States Patent [19]

Piesche et al.

[11] Patent Number: 4,737,604

[45] Date of Patent: Apr. 12, 1988

[54] THREE STAGE PRESSURE SWITCH

[75] Inventors: Gunter Piesche, Ubstadt-Weiher; Alois Krammer, Dudenhofen, both of Fed. Rep. of Germany

[73] Assignee: Ranco Incorporated, Dublin, Ohio

[21] Appl. No.: 915,847

[22] Filed: Oct. 6, 1986

Related U.S. Application Data

[63] Continuation-in-part of Ser. No. 757,528, Jul. 27, 1985, abandoned.

[51] Int. Cl.[4] ..... H01H 35/34

[52] U.S. Cl. ..... 200/83 J; 200/83 S; 200/81.4

[58] Field of Search ..... 73/717, 723, 745, 746; 340/60, 626; 92/7, 95, 96, 101, 130 D; 200/5 R, 5 A, 18, 81 R, 81.4, 81.5, 83 P, 83 B, 83 J, 83 S

[56] References Cited

U.S. PATENT DOCUMENTS

| | | | |
|---|---|---|---|
| 3,631,389 | 12/1971 | Elliott | 200/81.4 |
| 3,786,210 | 1/1974 | Byam | 200/81.4 |
| 4,273,976 | 6/1981 | Wolford et al. | 200/83 L |
| 4,330,695 | 5/1982 | Poling | 200/83 P |
| 4,467,155 | 8/1984 | Grudzien, Jr. | 200/81 R |

*Primary Examiner*—G. P. Tolin

*Attorney, Agent, or Firm*—Watts, Hoffmann, Fisher & Heinke

[57] ABSTRACT

A pressure switch device for use in an air-conditioning system, specifically a three stage device capable of switching, for example, a combined low/high pressure switch, and an on/off switch for activating compressor and condenser elements of the system, respectively. The device includes an operating chamber, a yieldable plastic membrane having roll membrane faces for transmitting system pressure level changes to pistons, a leaf spring disc and levers activating pairs of switching contacts. Upon application of three different operating pressures, each of the pistons transmitting a different pressure level, the levers and lever joints having tension springs, operate to bias the switching contacts to open and closed positions, thereby activating or deactivating the system elements.

21 Claims, 2 Drawing Sheets

THREE STAGE PRESSURE SWITCH

RELATED APPLICATION

This is a continuation-in-part of U.S. patent application Ser. No. 06/757,528, filed July 27, 1985, (now abandoned) entitled "Pressure Switch."

DESCRIPTION

1. Technical Field

This invention relates broadly to a pressure switch device, and more particularly to a three stage pressure switch for operation in air-conditioning systems.

2. Background Art

Pressure switch devices of various types have previously been available for activating electrical circuits in response to the application of operating system pressure. Conventional switches have often included flexible diaphragms, one side of which may be exposed to pressure levels resulting from system operation, and another side of which may be associated with switch assemblies capable of engaging electrical contacts upon the pressure responsive motion of the diaphragms. One problem encountered with such prior art switches has been their inability to provide a pressure switch responsive to numerous pressure levels, and which is simply constructed to maintain switch elements in alignment and compensate for spring tension variabilities, as well as reliably activate component devices in an air-conditioning system.

DISCLOSURE OF THE INVENTION

In accordance with this invention, a pressure switch device of the type to be connected to a source of operating system pressure is provided which, in addition to activating electrical apparatus in response to three stages of system pressure changes, is also simply constructed for ease of manufacture and reliable operation in an air-conditioning system. Another important feature of the present invention is the use of a deformable plastic membrane in communication with actuating apparatus for activating a combined low/high pressure compressor clutch switch and an on/off switch for a condenser fan in the system.

The advantages and features of the present pressure switch are achieved by constructing the device in a compact housing unit which can be connected to a source of system operating pressure. The housing unit includes a first chamber defined by a plastic membrane which is yieldably deformed to include three roll membrane faces upon application of the first and predetermined pressure level. A second chamber includes pistons which are vertically movable in response to the application of operating pressure to the membrane, and which are biased by a leaf spring disc having segments in communication with a switch assembly comprising tension springs and levers capable of moving electrical contacts into and out of engagement during operation of the device.

The above mentioned features of the present invention provide a pressure switch constructed in such a manner that upon application of a first pressure level, the plastic member moves against the bias of the switch assembly, contacting a first set of electrical switch contacts for activating one system function. When the system operating pressure reaches a second predetermined level the switch assembly becomes sufficiently biased by the plastic membrane to contact a second set of electrical contacts for activating a second system function. At a third pressure level the first switch contacts are opened, shutting off the first system function while operation of the second function via the second contacts is continued. As the system pressure level is reduced from the third level, the switching assembly operates to activate and deactivate system functions in a reverse sequence.

In one embodiment the device is preferably used in a vehicle air-conditioning system where circulating refrigerant serves as the source of system operating pressure. In this embodiment, the first system function activates a compressor clutch and the second system function activates a condenser ventilator.

The plastic membrane is adhered to a plate and contains roll face membranes which are first formed upon an initial application of pressure having a predetermined level. The roll face membranes are associated with pistons which are vertically guided within a pressure plate. The movable pistons are in commmunication with recesses in segments of the leaf spring disc. At least two of the segments being connected to levers to form lever joints. Tension springs are attached between points where the segments interconnect with the levers to form the lever joints, and a point on the pressure plate.

In the present embodiment, the disc segments are biased against the pressure plate by means of pressure springs having adjustment screws for providing adjustment of the spring pressure and consequently the system pressure levels to which the device responds. The levers preferably include insulating posts, which are sufficiently associated to open and close the switching contacts.

The above and other features and advantages of the present invention will become better understood from the detailed description that follows, considered in connection with the accompanying drawings.

BREIF DESCRIPTION OF THE DRAWINGS

BEST MODE FOR CARRYING OUT THE INVENTION

Figure 1:
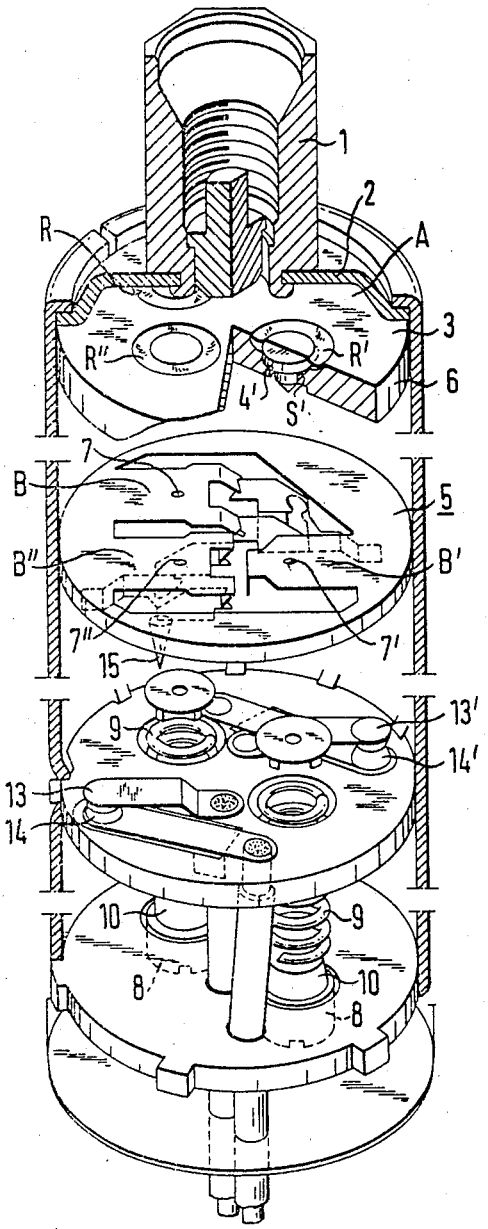
FIG. 1 is a perspective explosion view of a pressure switch of the present invention.
Figure 3:
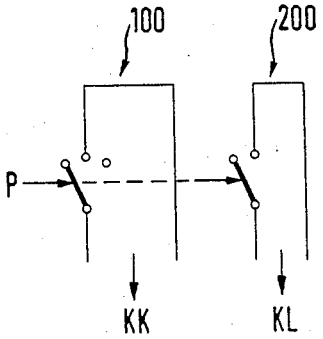
FIG. 3 is a schematic representation of two of the switches of the pressure switch embodying the invention.

Referring to the detailed drawings, FIGS. 1 and 3 illustrate the pressure switch of the present invention. The pressure switch device includes a pressure chamber A, connected to a source of operating pressure P, as shown in FIG. 3, and is defined by a plastic membrane 3. The plastic membrane 3, is preferably associated with a pressure plate 6 housing pistons 4, 4' and 4'', which is also in communication with a leaf spring disc 5 and pressure springs 9, the bias of which may be adjusted by means of adjustment screws 8. A switch assembly including switching contacts 13, 14 and 13', 14', levers 11, 11', and lever joints having tension springs 12, 12' in association with segments of the leaf spring disc B, B', B'', may be activated upon application of operating pressures.

The pressure switch shown in FIGS. 1 and 3 includes a screw connection 1, for connection with a source of operating pressure P in a vehicle air-conditioning system. The pressure chamber A is defined on one side by a plate 2 connected with the screw connection 1, and on another side by a plastic membrane 3.

The plastic membrane 3 is preferably manufactured of a polyimide film capable of being yieldably deformed upon the application of pressure to the pressure chamber A, to include roll membrane faces R, R' and R'' which are formed at three positions in the common plan of the plastic membrane. The roll membrane faces are formed in the plastic membrane on a side associated with the pressure chamber A. The opposing side of the plastic membrane 3 is supported on a pressure plate 6 containing three apertures for housing pistons 4, 4' and 4''. The pistons are vertically guided in the pressure plate 6 and limited in their movement by bottom stop means S, S' and S''. Use of the deformable plastic membrane 3 to include the three roll membrane faces silhouetting the pistons, permits a longer operating path for the pistons and a corresponding increase in the operating pressure which can be transmitted to the leaf spring disc 5.

The leaf spring disc 5 includes three segments B, B' and B'', each of which contains a recess 7, 7', 7''. The pistons 4, 4', 4'' are positioned to be radially guided within the recesses 7, 7', 7'' to act upon the leaf spring disc 5.

Spiral pressure springs 9 bias disc segments B, B', B'' of the leaf spring disc 5, and the corresponding pistons 4, 4', 4'' and roll membrane faces R, R', R'' in the plastic membrane. The pressure springs are engaged on an end opposite the disc segments by nut members 10. The nut members include a collar which engages the pressure spring, and are internally threaded to engage adjustment screws 8. The adjustment screws are located at an end of the pressure switch opposite from the screw connection 1, and permit changes or adjustment of pressure spring tension, thereby avoiding problems experienced in the prior art concerning spring tension variation and relaxation in components such as the membrane. Specific tension levels of the pressure springs 9 are selected based on the level of system operating pressure desired to activate the switch assembly. The spring tension levels are selected such that the operating pressures P applied to the pressure chamber A must exceed the spring tension in order to overcome the pressures exerted by the pressure springs 9. As the level of operating pressure P increases, the pistons 4, followed by the piston 4', and finally the piston 4'', vertically move against their corresponding stop means S, S', S'' in the pressure plate 6, as the tension level of the respective pressure springs is overcome.

The switch assembly is positioned beneath the leaf spring disc 5 and includes two levers 11, 11' and tension springs 12, 12', which together with the disc segments B, B' form lever joints X, X'. Switching contacts 13, 14, or 13', 14' are respectively arranged below the levers 11 or 11'. Insulating bodies or posts 15, 15', are secured on one side of the levers 11, 11' for engagement with resilient contact tongues of the movable switching contacts 14, 14' for opening and closing of the switching contacts. Adjustable stop means D1, D2 or D1', D2' are provided for limiting the paths of the levers 11, 11', respectively.

A tension spring 12 is positioned between a securement point Y on lever 11 and a securement point Z on the disc segment B''. Tension spring 12' is mounted between securement point Y' on the lever 11' and a securement point at a fixed location on the pressure plate 6. In the preferred embodiment the securement points are selected such that the lever joints X, X' are situated between the pairs of securement points Y and Z and Y' and the fixed point, respectively.

During the stage of system operation when pressure less than that of level I is applied to chamber A of the pressure switch, levers 11, 11' are biased by tension springs 12, 12' into engagement with the stop means $D_1$, $D_1'$. The position of the levers 11, 11' causes the insulating bodies 15, 15' to engage the resilient contact tongues associated with switching contacts 14, 14', maintaining the switching contacts 13, 14 and 13', 14' in an open position. The position of lever joint X and securement point Z, and lever joint X' and the securement point at the fixed position on the pressure point 6 are specifically selected such that the tension spring 12, 12' and their corresponding levers 11, 11' bias the contacts to an open position when the system is in a pressureless state.

Figure 4:
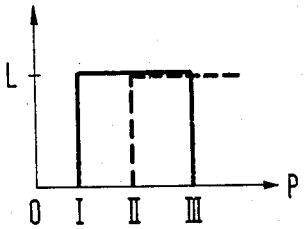
FIG. 4 is a diagram of the operating system pressure versus the operation of the three stage pressure device embodying the invention.
Figure 2:
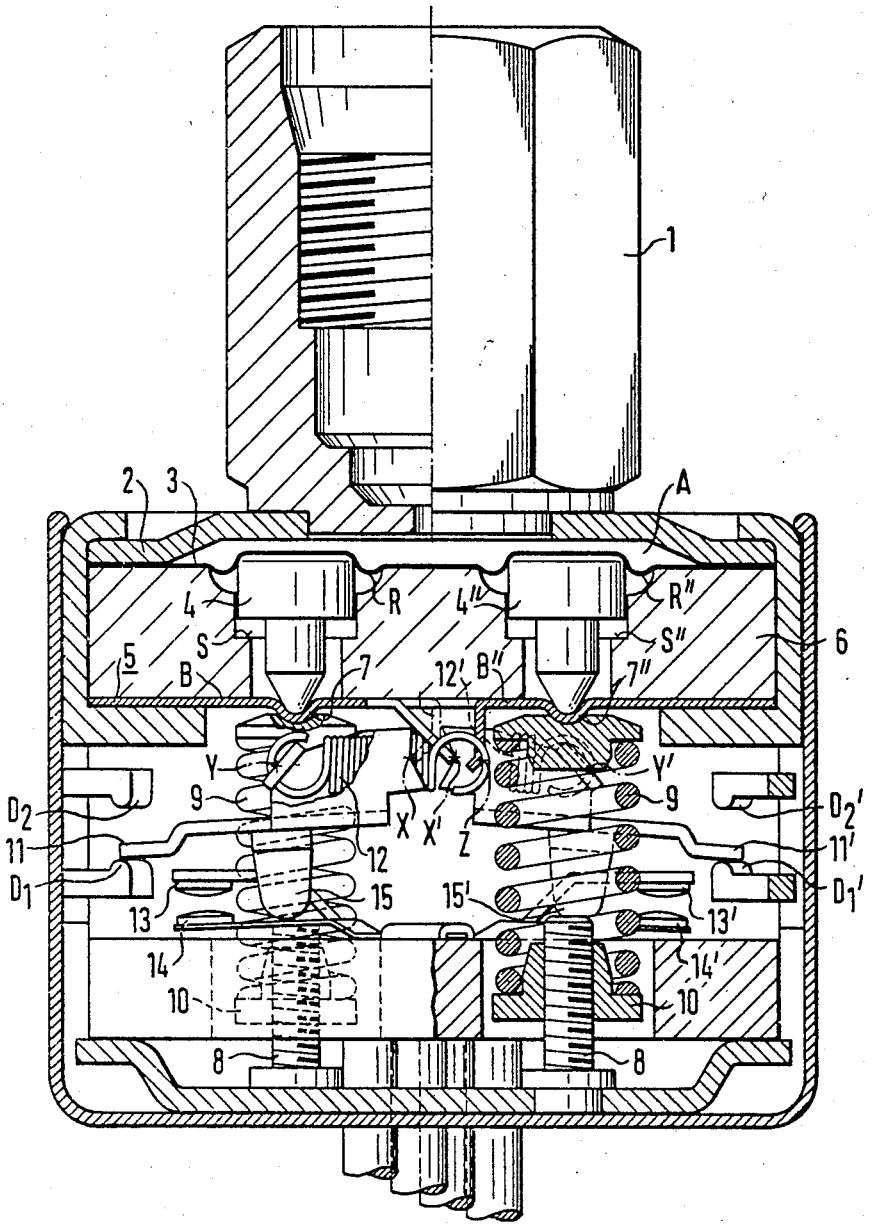
FIG. 2 is a cross-sectional view of the pressure switch device of FIG. 1.

During operation of the air-conditioning system, piston 4 first moves toward the stop means S upon application of increased operating pressure P to the pressure chamber A of a degree equal to a first pressure level I as shown in FIG. 4. As piston 4 moves against segment B of the leaf spring disc, tension spring 12 is overcome by the pressure asserted, and causes lever joint X to cross the point of equilibrium between securement points Y and Z which maintains lever 11 in contact with stop means D1. Upon the passing of this critical point, the lever 11 moves against the stop means D2. The movement of the lever 11 releases insulating body 15 from engagement with the resilient contact tongue of the movable switching contact 14 such that the pair of switching contacts 13, 14 provide an electrical connection for activating system devices. As illustrated in FIG. 3, the electrical connection provided by the engagement of switching contacts 13 and 14 corresponds with a switch 100 which in the disclosed embodiment for example, activates a combined low/high pressure switch for a compressor clutch KK of a vehicle air-conditioning system.

As the operating pressure P applied to pressure chamber A increases to a pressure level II, as shown in FIG. 4, piston 4' vertically moves towards the stop means S'. As the movement of piston 4' against segment B' of the leaf spring disc 5 exceeds the level of tension exerted by tension spring 12', which maintains lever 11' in contact with the stop means D1', the lever joint passes the point of eqiulibrium between points X' and the fixed point on pressure plate 6, moving the lever 11' into engagement with stop means D2'. The movement of lever 11' disengages insulating body 15' from communication with the resilient contact tongue of movable switching contact 14' and engages contacts 13' and 14'. This engagement of the contacts closes the electrical connection which corresponds to switch 200 shown in FIG. 3. In a preferred embodiment, the switch 200 is an on/off switch of a condenser fan KL of a vehicle air-conditioning system.

As the operating pressure P continues to increase to a pressure level III as again shown in FIG. 4, piston 4'' moves toward the stop means S''. As the disc segment B'' is biased by piston 4'' beyond securement point Z, the point of equilibrium maintaining the lever 11 against stop means D1, lever 11 reverts to its original position against the stop means D1, thus reopening the pair of switching contacts 13, 14, and the corresponding switch 100 for the device KK.

As the system continues to operate and the operating pressure P decreases to a pressure level below the value of level I, for example to zero, the switching stages previously described are performed in reverse sequence, and the pressure switch is ready to repeat the cycle.

With the described pressure switch, it is possible to replace prior art pressure controlled switches used in vehicle air-conditioning systems with a single unit capable of responding to three stages of system pressure changes.

While a preferred embodiment of this invention has been described in detail, it will be apparent that certain modifications or alterations can be made therein without departing from the spirit and scope of the invention set forth in the appended claims.

We claim:

1. A pressure switch comprising:

(a) a housing unit having at least one operating chamber in communication with a pressure source;

(b) said chamber including a plastic membrane supported by a support plate and deformable in response to predetermined pressure applied to said operating chamber;

(c) said membrane including roll membrane faces formed by deformation of the membrane by said predetermined pressure;

(d) actuating means located on a side of said membrane opposing said faces for transmitting pressure changes;

(e) a switch assembly biased by said actuating means in response to at least two differing pressures;

(f) said assembly having a leaf spring disc in contact with said actuating means and connected to at least two pressure springs and a lever apparatus movably activating associated switch contacts; and (g) an adjustment means in communcation with said pressure springs for varying the amount of pressure capable of activating said assembly.

2. A pressure switch as claimed in claim 1 wherein said actuating means comprises at least two pistons being vertically guided within a pressure plate having bottom stop means for limiting piston movement.

3. A pressure switch as claimed in claim 1 wherein said leaf spring disc includes at least two segments being biased toward said pressure plate by said pressure springs, and away from said membrane by said pistons.

4. A pressure switch as claimed in claim 3 wherein said switch assembly lever apparatus includes levers, each of said levers a having post associated with a tongue of said switch contact, and being connected to said disc segments by at least two tension springs positioned between securement points on said segments and a fixed point on said pressure plate.

5. A pressure switch comprising:

(a) a housing unit having first and second operating chambers;

(b) said first chamber connected to a source of operating pressure and defined in part by a plastic membrane having at least first and second annular roll membrane faces yieldably deformed by application of pressure in said chamber;

(c) said second chamber including first and second pistons each engaging said membrane within a respective roll membrane face, each piston movable in response to operating pressure acting upon said plastic membrane, and a leaf spring disc having first and second segments in contact with said pistons;

(d) a switch-back assembly including switching contacts associated with lever joints defined by levers and segments of said leaf spring disc, tension springs engaged with said disc segments, and a fixed point on one of said disc segments; and (e) said assembly being biased by said first piston upon application of one operating pressure and by said second piston upon application of another operating pressure.

6. A pressure switch as claimed in claim 5, wherein said pistons are supported in said second chamber by a pressure plate having bottom stop means for limiting piston movement.

7. A pressure switch as claimed in claim 6, wherein said plastic membrane is adhered to a plate supported by said pressure plate.

8. A pressure switch as claimed in claim 6, wherein said disc segments are biased toward said pressure plate by pressure springs having adjustment means for varying the spring bias.

9. A pressure switch as claimed in claim 5, wherein said pistons are radially guided by recesses in said leaf spring segments.

10. A pressure switch as claimed in claim 5, wherein adjustable stops are provided for controlling movement of said levers.

11. A pressure switch according to claim 5, wherein insulating bodies are provided on said levers movably contacting resilient tongues of said contacts.

12. A pressure switch comprising:

(a) a housing providing an internal chamber portion in communication with a pressure source;

(b) at least first and second pressure actuated control means supported in said housing;

(c) a support plate fixed in said housing between said chamber portion and said control means, said support plate defining at least first and second guideways each extending through said support plate;

(d) said control means including respective operating plungers extending through said support plate via said guideways;

(e) a thin flexible membrane supported by said housing and defining a wall of said chamber, said membrane supported by said plate and engaging said plungers for transmitting pressure forces from said chamber individually to said plungers said membrane including first and second yielded annular roll sections disposed respectively about said first and second plungers, said roll sections moving when the plungers are actuated to prevent resilient deformation of said membrane; and (f) said plungers biased toward said membrane to resiliently resist pressure responsive motion.

13. A pressure switch as claimed in claim 12 wherein said support plate defines annular roll section supporting recesses about said respective guideways.

14. A pressure switch as claimed in claim 13 wherein said roll sections are yieldably formed in situ upon application of a predetermined over-pressure to said chamber with said supporting recesses shaping said roll sections.

15. A pressure switch comprising two pairs of switching contacts and a pressure chamber, which can be connected to a source of operating pressure, and is terminated towards said pairs of switching contacts by a plastic membrane, which acts via pistons and a leaf spring disc on said pairs of switching contacts, further comprising three roll membrane faces provided in said plastic membrane in a common plane, which are in connection with three vertically guided pistons, said leaf spring disc having three disc segments, two of which form together with two levers lever joints, said segments being biased in such a manner that upon three different operating pressures, under the effect of one each of said three pistons and the according roll membrane face they are moved vertically, and one tension spring each being provided between securement points on two of said disc segments and a securement point on said third disc segments or a fixed point, respectively, said lever joints being respectively arranged in the region between said securement point of said two disc segments and said securement point of said third disc segment or said fixed point, respectively.

16. A pressure switch according to claim 15 wherein said pistons are guided vertically in a pressure plate comprising bottom stop means.

17. A pressure switch according to claim 16, wherein said plastic membrane is adhered to a plate resting on said pressure plate.

18. A pressure switch according to claim 17, wherein disc segments are pressed against said pressure plate by spiral pressure springs biased by means of adjustment screws.

19. A presssure switch according to claim 15, wherein said pistons are guided radially by means of recesses in said disc segments of said leaf spring disc.

20. A pressure switch according to claim 15, wherein adjustable stop means are provided which limit the paths of said levers.

21. A pressure switch according to claim 15, wherein on said levers insulating bodies are provided, which press upon resilient contact tongues of said pair of switching contacts to open said switching contacts.

* * * * *

UNITED STATES PATENT AND TRADEMARK OFFICE

CERTIFICATE OF CORRECTION

PATENT NO. : 4,737,604

DATED : April 12, 1988

INVENTOR(S) : Gunter Piesche

It is certified that error appears in the above—identified patent and that said Letters Patent is hereby corrected as shown below:

On the cover sheet, before "Related U.S. Application Data" insert the following:

[30] Foreign Application Priority Data

Jul. 26, 1984 [DE] Fed. Rep. of Germany.....G8422298.0

Signed and Sealed this

Tenth Day of January, 1989

*Attest:*

*Attesting Officer*

DONALD J. QUIGG

*Commissioner of Patents and Trademarks*